United States Patent [19]

Kurtz

[11] Patent Number: 4,639,971

[45] Date of Patent: Feb. 3, 1987

[54] DOOR HINGE SHIM

[76] Inventor: Thomas D. Kurtz, 1101 First Ave., Rock Falls, Ill. 61071

[21] Appl. No.: 314,100

[22] Filed: Oct. 23, 1981

[51] Int. Cl.[4] ..... E05D 7/04

[52] U.S. Cl. ..... 16/247; 16/114 R; 16/DIG. 39; 403/4; 403/408.1

[58] Field of Search ..... 16/110 R, 114 R, 237, 16/242, 246, 247, 249, 362, 363, 364, DIG. 39; 411/511, 546, 531, 538, 539; 403/4, 408, 409

[56] References Cited

U.S. PATENT DOCUMENTS

| | | | |
|---|---|---|---|
| 566,323 | 8/1896 | Kelleher | 16/249 |
| 1,141,303 | 6/1915 | Bennett et al. | 16/249 |
| 2,154,716 | 4/1939 | Anderson | 16/247 |
| 2,885,722 | 5/1959 | Halliday | 16/237 |
| 3,229,323 | 1/1966 | Hensgen | 16/247 |
| 4,165,115 | 8/1979 | Olsson | 16/114 R X |
| 4,262,577 | 4/1981 | Katz | 411/15 |

*Primary Examiner*—Fred Silverberg
*Attorney, Agent, or Firm*—Vernon J. Pillotte

[57] ABSTRACT

A door hinge shim for use with hinge mounted doors to control the spacing beween first and second members that are interconnected by a set of threaded fasteners. The shim plate has slots opening in one of its edges at locations to receive the shanks of the fasteners and a shim installing handle is formed integrally with the shim plate and extends outwardly therefrom to facilitate manipulation of the shim plate during installation. A line of weakness is formed in the handle at its juncture with the shim plate to facilitate breaking of the handle off the shim plate after installation. Teeth are provided on one or more of the slots in the shim plate to engage the shanks of the hinge plate mounting fastener and to hold the shim plate in adjusted position.

5 Claims, 7 Drawing Figures

DOOR HINGE SHIM

BACKGROUND OF THE INVENTION

When mounting doors on hinges in a door casing, it is common practice to use hinge shims to adjust the clearance between the edges of the door and the door casing. Such shims are frequently hand made at the job site from one or more layers of cardboard or the like. However, hand cutting of the shims and forming of holes for the hinge mounting fasteners is both tedious and time consuming. In addition, installation of such shims was tedious and time consuming since it required removal of the hinge plate from the door or door casing in order to allow insertion of the hinge mounting fasteners through the holes in the shim. Preformed shims have also been made of sheet metal with holes to receive some of the hinge mounting fasteners and slots to accommodate others of the hinge mounting fasteners. While such prior preformed hinge shims avoided the problems and delays encountered in hand forming of hinge shims at the job site, they were still somewhat tedious and time consuming to install and required complete removal of at least some of the hinge mounting fasteners.

SUMMARY OF THE INVENTION

It is the general object of the present invention to overcome the disadvantages of the prior art by providing a preformed door hinge shim which can be easily installed without requiring removal of the hinge plate or hinge mounting fasteners.

Accordingly, the present invention provides a door hinge shim for use with hinge mounted doors to adjust the hinge mounting of a door on the door casing, the hinge mounting including first and second members interconnected by a set of threaded fasteners, the shim comprising a generally rectangular shim plate having a plurality of slots opening at one of its edges at locations to receive the shanks of the set of fasteners when the fasteners are loosened and the shim plate is inserted between the first and second members, and a shim installing handle integral with the second edge of the shim plate opposite said one edge and extending outwardly from the shim plate, the shim installing handle having a line of weakness formed at its juncture with the second edge of the hinge plate to facilitate breaking of the shim installing handle off the shim plate after installation of the shim.

In accordance with another aspect of the present invention, at least one of the slots in the shim plate is formed with teeth on opposite side edges that extend toward each other with the apices spaced apart a distance slightly less than the diameter of the shanks of the threaded fasteners to releasably engage the shanks of a fastener and hold the shim plate in a selected position.

In accordance with another aspect of the present invention, the shim plate can be formed with a tapered configuration to adjust for hinge bound doors.

These, together with other objects, advantages and features of the present invention will become apparent from the following description when taken in connection with the accompanying drawings wherein.

Figure 1:
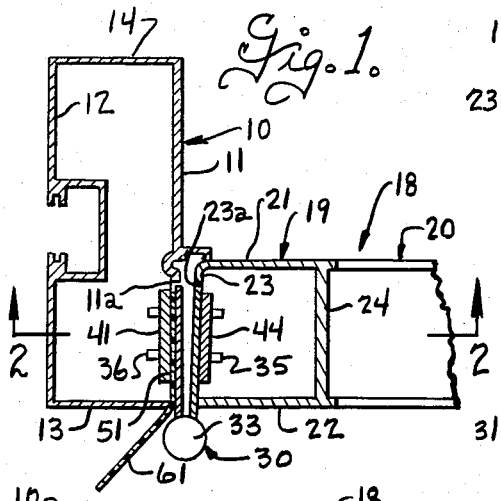
FIG. 1 is a fragmentary horizontal sectional view through a door and door casing illustrating installation of a hinge shim to reduce the clearance at the free end of the door.
Figure 2:
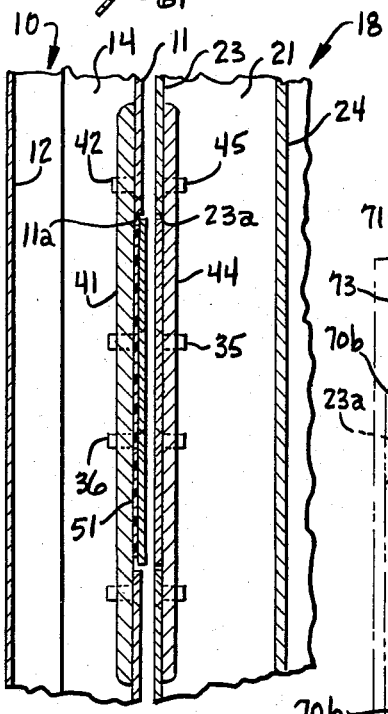
FIG. 2 is a fragmentary vertical sectional view taken on the plane 2—2 of FIG. 1.

The door hinge shim is generally adapted for use on doors mounted by butt type hinges on a door casing and may be used with either wood or metal doors and door casings. In the embodiment illustrated, the door casing 10 is formed of a metal extrusion of generally rectangular configuration and including inner and outer side walls 11 and 12 and first and second end walls 13 and 14 that extend between the side walls. In the embodiment illustrated, the door 18 is also formed of metal and includes vertically extending stiles 19 that are interconnected by horizontally extending rails 20. As best shown in FIGS. 1 and 2, the stiles have a generally box shape cross-section with first and second face walls 21 and 22 interconnected by transverse walls 23 and 24. The rails 20 also have a generally box shape configuration and are secured at their ends as by welding to the upright stiles 19. As is conventional, panels (not shown) of glass or other material extend between the rails and stiles to complete the door.

The door is mounted on the casing by butt type hinges 30 consisting of a pair of hinge plates 31 and 32 having interfitting knuckles **31*a* and 32*a* that are pivotally interconnected by a hinge pin 33. As is conventional, the hinge plates 31 and 32 are each formed with a plurality of fastener receiving openings in a preselected pattern to receive a set of hinge mounting fasteners 35 and 36 for attaching the hinge plates to the door and door casings respectively. The edge of the door and the inner face of the door casing are commonly mortised or recessed to receive the respective hinge plate so that it can lie substantially flush with the edge of the door and the face of the casing. In the metal type door casing illustrated, an opening 11*a* is cut through the inner side wall 11 of the door casing of a size to receive one of the hinge plates. A hinge mounting strap 41 extends across the hinge plate opening 11*a* with end portions of the strap extending beyond the hinge plate opening inside the casing 10 and secured to the inner side wall 11 by strap attaching fasteners 42 that extend through openings in the inner side wall 11 and are tapped into the end portions of the strap 41. The portion of the strap 41 that extends across the opening 11*a* is offset from the outer face of the inner side wall 11 a distance such that the hinge plate 31 has its outer face disposed substantially flush with the outer face of the side wall 11. Similarly, the metal door 18 has an opening 23*a* cut through the wall 23 of a size to receive one of the hinge plates 31 and a hinge mounting strap 44 is disposed inside the hollow stile 19 to extend across the hinge plate opening 23*a* with end portions of the strap underlying the wall 23 at opposite ends of the opening. The end portions of the strap are secured to the wall 23 by fasteners 45 that extend through openings in the wall 23 and are tapped into the end portions of the strap 44. As best shown in FIGS. 1 and 2, the outer face of the strap 44 is offset from the outer face of the wall 23** so that the hinge plate is disposed substantially flush with the edge of the door.

In accordance with the present invention, a preformed door hinge shim 50 is provided for shimming between either the door casing and the hinge plate attached thereto or between the door and the hinge plate attached thereto. The door hinge shims include a shim plate 51 having a length preferably slightly less than the length of the hinge plate opening in the door and door casing and a width somewhat less than the width of the hinge plate opening in the door and door casing. The hinges are made in a plurality of different standard sizes, for example 3, 3½, 4 and 4½ inches long, and the shim plates are also made in different sizes corresponding the different size hinges.

For example, for a standard 4½ inch hinge, the shim plate preferably has a length of about 4 15/16 inches and a width of about 1 7/16 inches. The shims are preferably formed in different thicknesses, for example 1/32, 1/16 and 3/32 inches thick to accommodate different shimming requirements. Alternatively, several thin shim plates can be utilized for increased shimming if desired.

Figure 3:
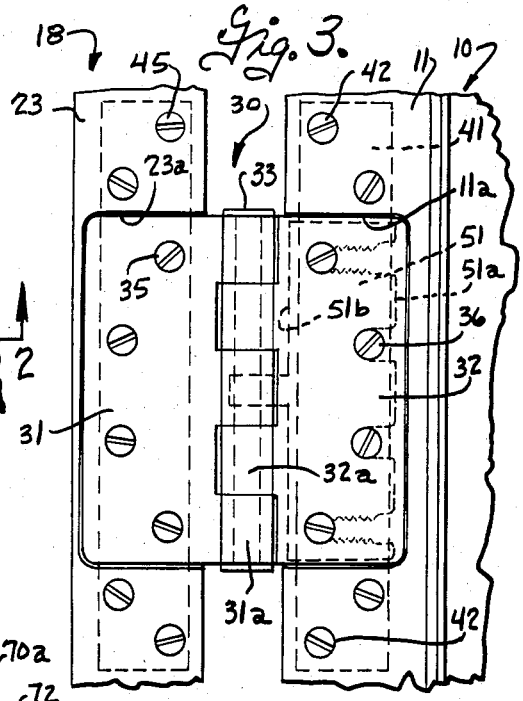
FIG. 3 is a fragmentary elevational view illustrating the door and door casing with the door in its fully open position.
Figure 4:
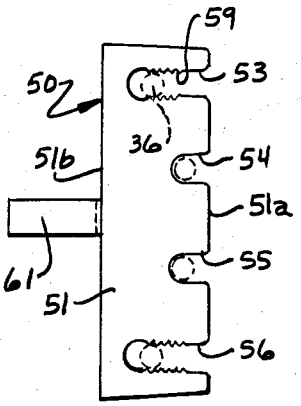
FIG. 4 is a side elevational view of the hinge shim shown in FIGS. 1–3.

The shim plates are formed with a plurality of fastener receiving slots, corresponding to the number of the fastener receiving openings in the hinge plate. The hinge plates of the hinges illustrated in the drawings have four fastener receiving openings arranged in a preselected pattern and the shim plate for such a hinge has four fastener receiving slots designated 53–56. The slots open at one edge 51*a* of the shim plate and extend into the shim plate a distance determined by the pattern of the fastener receiving openings in the hinge plate to allow the shim to be inserted by sliding between the hinge plate and the door or door casing when the hinge mounting fasteners are loosened. The hinge shim is preferably inserted to a depth such that its outer edge 51*b* is disposed substantially flush with the outer face of the door or door casing. However, while the hinge plate size and location of the fastener receiving openings therein are generally standardized for the different size hinges, the doors are made in different thicknesses, Consequently, the distance between the free edge of the hinge plate and the outer face of the door or door casing, and hence the position of the fastener receiving holes relative to the outer face of the door or door casing, can vary with different thickness doors. The provision of slots in the hinge shim rather than openings allows adjustment of the position of the hinge shim relative to the hinge plates so that its outer edge 51*b* can be positioned adjacent the outer face of the door and door casing. In order to hold the shim plate in position after it has been inserted a desired depth, at least one and preferably several of the slots such as 53 and 56 are formed with teeth 59 on opposite side edges that extend toward each other with the apices of the teeth spaced apart a distance slightly less than the diameter of the shank of the threaded hinge mounting fasteners to releasably engage the fasteners and hold the shim plate in position. The teeth 59 are advantageously formed on the relatively deep slots 53 and 56 as best shown in FIGS. 3 and 4. The shim plate is preferably formed of a synthetic resin material which is sufficiently resilient to allow the teeth to deflect and move past the shank without breaking as the shim is inserted, and which is yet sufficiently dense to provide a firm abutment when the hinge mounting fasteners are tightened to clamp the hinge plate against the door or door casing. The shims may, for example, be formed of high impact polystyrene material, a polycarbonate material or the like.

Figure 5:
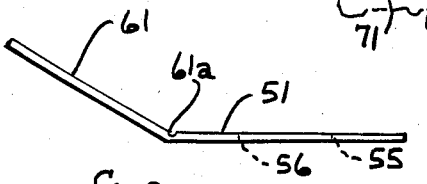
FIG. 5 is an end elevational view of a flat form hinge shim and handle on a larger scale than FIG. 4.
Figure 6:
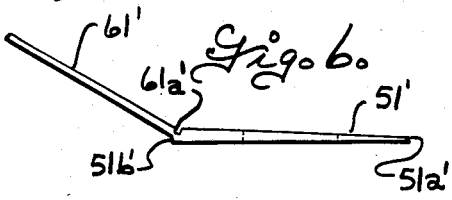
FIG. 6 is an end elevational view of a tapered form hinge shim and handle.

A shim installing handle 61 is advantageously provided to facilitate insertion of the hinge shim between the hinge plate and the door or door casing. The handle 61 is formed integrally with the edge 51*b* of the shim plate and extends outwardly from the shim plate. A line of weakness 61*a* is formed in the handle at its juncture with the edge 51*b* of the shim plate to facilitate breaking of the shim installing handle off the shim plate after the shim is installed. The line of weakness can be an area of reduced cross-section as shown or it may be formed by cutting a perforation. The handle 61 is advantageously shaped to extend at an angle to the plane of the shim plate, as best shown in FIGS. 1, 5 and 6, so as to clear the knuckles on the hinge when installed. As shown, the handle 61 diverges at an acute angle relative to the plane of the shim plate.

The door hinge shim 50 can be used between either the door casing or the door and the hinge plate attached thereto to shift the door relative to the door casing in a direction to decrease clearance at the free edge of the door. As previously described, the shim plates can be made of different thicknesses to shim the door a greater or lesser amount and several shim plates can be utilized to increase the amount of shifting of the door. In some installations, for example when the door frame is distorted or bent during installation, the door can become hinge bound; that is, the hinge plates abut each other as the door approaches closed position and exert a force which tends to cause the door to spring back. In order to compensate for hinge bound doors, a modified shim plate 51' can be formed as shown in FIG. 6 with an outward taper from the edge 51*a'* to the edge 51*b'*. When the tapered hinge shim is inserted between either the door casing or the door and the hinge plate attached thereto, the spacing between the hinge plate and the door or door casing is increased to a greater extent adjacent the hinge knuckles than adjacent the free edge of the hinge plates to thereby increase the clearance between the hinge plates adjacent their free edges. The shim 51' is also advantageously formed with a handle 61' integrally with the edge 51*b'* and having a line of weakness 61*a'*.

Figure 7:
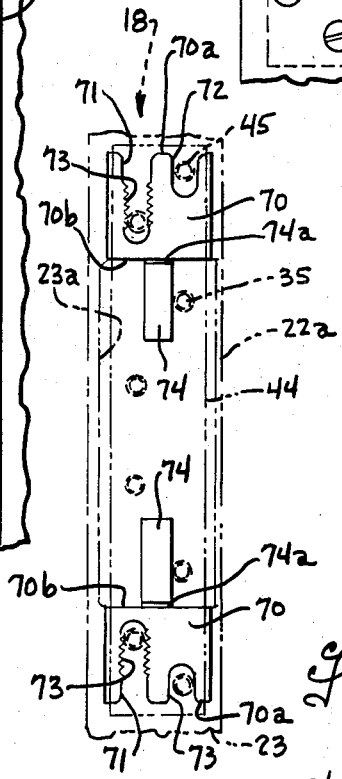
FIG. 7 is an end elevational view of a modified form of door hinge shim for use on hollow metal doors and door casings to adjust the door to increase the clearance at the free edge of the door.

In some door installations, there is insufficient clearance at the free edge of the door. When the door or door casing is of the metal type shown in FIG. 1 in which the hinge plates are attached to hinge mounting straps in the door and door casing, some increase in the clearance at the free edge of the door can be achieved by inserting shims between the end portions of the hinge mounting strap and the inner side of the door or door casing. In FIG. 7 there is illustrated a pair of hinge shims 70 for shimming the hinge portions of the hinge mounting strap relative to the door 18, it being understood that the shim 70 could also be utilized between the hinge mounting strap 41 and the door casing 10. The door hinge shims 70 have a width less than the width of the hinge plate receiving opening such as 23*a* in the door to allow insertion of the shim through that opening when the hinge plate is removed. The shim plate has a length to extend from the edge of the hinge plate receiving opening 23*a* a distance somewhat beyond the fasteners that attach the hinge mounting strap to the door or door casing, and the hinge plate has slots 71 and 72 opening at one edge 70*a* of the shim plate and extending into the shim plate a distance somewhat greater than that necessary to receive the shanks of the fasteners, when the other edge 70*b* of the shim plate is disposed substantially flush of the edge of the hinge plate receiving opening. Teeth 73 are provided on the adjacent edges of at least one of the openings 71 and extend toward each other with their apices spaced apart a distance less than the diameter of the shanks of the strap attaching fasteners to engage the shanks of the fasteners and hold the shim plate in the position to which it is inserted. A shim plate installing handle 74 is formed integrally with the shim plate at the edge 70*b* thereof and extends laterally from the shim plate, preferably at an acute angle to the plane of the shim plate. A line of weakness 74*a* is formed in the handle at the juncture with the edge 70*b* to facilitate breaking of the handle off from the shim plate after it is installed. The shim plate 70 can be made in different thicknesses for example 1/32 and 1/16 inches to increase the clearance at the free edge of the door by a corresponding amount. In installing the door hinge shim 70, it is necessary to remove the hinge plate from the door or door casing; loosen the strap mounting fasteners such as 45, and then insert a shim plate between each of the projecting ends of the strap and the inside of the door or door casing. Thereafter the strap mounting fasteners 45 are tightened and the handle 74 broken off. The shims increase the offset between the outer face of the strap and the outer face of the wall of the door or door casing to which the strap is attached and it is necessary to file or otherwise cut down the edge such as 22*a* of the outer wall of the door or door casing so that it is disposed generally flush with the outer face of the strap 44. The hinge plate can then be remounted on the hinge mounting strap.

From the foregoing it is thought that the construction and use of the door hinge shims will be readily understood. The door hinge shims 50 are adapted for use between the hinge plate and the door or door casing to shift the hinge and the door in a direction to decrease the clearance at the free edge of the door. The shims 50 can be easily installed without removing the door or hinge from the door or door casing. It is only necessary to loosen the hinge mounting fasteners and then insert the shim plate between the hinge plate and the door or door casing. The handle facilitates manipulation of the hinge shim during installation and the elongated slots in the shim plate receive the hinge mounting fastener and allow adjustment of the depth to which the hinge shim is inserted. The teeth 59 on one or more of the slots engage the shanks of the hinge mounting fasteners and hold the shim plate in the adjusted position until the fasteners are tightened to clamp the shim in position. The tapered form of hinge shims 51' shown in FIG. 6 are adapted for use with so-called hinge bound doors, to increase the clearance between the free edges of the hinge plates and prevent contact between the hinge plates when the door is closed. The door hinge shims 70 are utilized on metal doors or door casings to shift the door in a direction to increase the clearance at the free edge of the door. The door hinge shims 70 are inserted between the ends of the hinge mounting straps and the door or door casing and shift the straps in a direction to increase the offset between the straps and the outer face of the associated wall of the door or door casing.

The embodiments of the invention in which an exclusive property or privilege is claimed and defined as follows:

1. A door hinge shim for use with hinge mounted doors to adjust the hinge mounting of a door on a door casing, the hinge mounting including first and second members interconnected by a set of threaded fasteners, the shim comprising a generally rectangular shim plate having a plurality of slots opening at a first edge at locations to receive the shanks of the set of fasteners when the fasteners are loosened and the shim plate is inserted between the first and second members, and a shim installing handle integral with a second edge of the shim plate opposite said first edge and extending outwardly from the shim plate, the shim installing handle having a line of weakness formed therein at its juncture with said second edge of the shim plate to facilitate breaking of the shim installing handle off the shim plate after installation of the shim, at least one of the slots in the shim plate having teeth on opposite side edges extending toward each other with the apices of the teeth spaced apart a distance slightly less than the diameter of the shanks of the threaded fasteners to releasably engage the shank of a fastener and hold the shim plate in a selected position.

2. A door hinge shim according to claim 1 wherein the shim plate and handle are formed of a synthetic resin material.

3. A door hinge shim for adjusting a door member mounted by butt type hinges on a door casing member, each butt type hinge including a pair of hinge plates having interfitting hinge knuckles along one edge interconnected by a hinge pin, one hinge plate being attached to one of the members by a set of threaded fasteners extending through holes in said one hinge plate and into said one member, the other hinge plate being attached to the other of the members by a set of threaded fasteners extending through a group of holes in said other hinge plate and into the other member, the door hinge shim comprising an elongated shim plate having a plurality of slots opening at a first side edge at locations to receive the shanks of the set of threaded fasterners when the shim is inserted between one of said hinge plates and the member to which it is attached, and a shim installing handle integral with a second edge of said shim plate opposite said one edge and extending outwardly therefrom, the shim installing handle having a line of weakness formed therein at the juncture with said second edge of the shim plate to facilitate breaking of the shim installing handle from the shim plate after installation, at least one of the slots in the shim plate having teeth extending crosswise of the slot a distance sufficient to releasably engage the shank of a fastener and hold the shim plate in a selected position.

4. A door hinge shim according to claim 3 wherein said shim plate is formed of a synthetic resin material.

5. A door hinge shim for adjusting a door member mounted by butt type hinges on a door casing member, each butt type hinge including a pair of hinge plates having interfitting hinge knuckles along one edge interconnected by a hinge pin, one hinge plate being attached to one of the members by a set of threaded fasteners extending through holes in said one hinge plate and into said one member, the other hinge plate being attached to the other of the members by a set of threaded fasteners extending through a group of holes in said other hinge plate and into the other member, the door hinge shim comprising an elongated shim plate having a plurality of slots opening at a first side edge at locations to receive the shanks of the set of threaded fasteners when the shim is inserted between one of said hinge plates and the member to which it is attached, at least one of said slots in the shim plate having teeth on opposite side edges extending toward each other with the apices of the teeth spaced apart a distance slightly less than the diameter of the shanks of the threaded fasteners to releasably engage the shank of a fastener and hold the shim plate in a selected position, and a shim installing handle integral with a second edge of the shim plate opposite the first edge and extending outwardly therefrom, the shim installing handle having a line of weakness formed therein at the juncture with said second edge of the shim plate to facilitate breaking of the shim installing handle from the shim plate after installation.

* * * * *